United States Patent [19]

Przystawik

[11] Patent Number: 4,826,079

[45] Date of Patent: May 2, 1989

[54] MOVING MEANS FOR FOUNTAIN NOZZLE

[76] Inventor: Gunter Przystawik, 5230 Tamiami Ct., Cape Coral, Fla. 33904

[21] Appl. No.: 187,903

[22] Filed: Apr. 29, 1988

[51] Int. Cl.[4] ..... F21P 7/00; B05B 3/14; B05B 3/16; E04G 7/00

[52] U.S. Cl. ..... 239/19; 239/162; 239/242; 239/263.1; 239/263.3; 239/265; 239/395; 403/49

[58] Field of Search ..... 239/17, 19, 242, 263.1, 239/263.3, 264, 265, 229, 395, 162, 587; 403/49, 66, 72, 163

[56] References Cited

U.S. PATENT DOCUMENTS

| | | | |
|---|---|---|---|
| 246,466 | 8/1881 | Cretcher | 403/66 |
| 1,900,837 | 3/1933 | Mills | 239/162 X |
| 2,369,950 | 2/1945 | Daly | 239/265 |
| 2,411,964 | 12/1946 | Grass | 239/162 X |
| 2,610,088 | 9/1952 | Randell | 239/162 |
| 2,722,453 | 11/1955 | Moore | 239/162 |
| 3,077,306 | 2/1963 | Herzog | 239/17 |
| 3,907,204 | 9/1975 | Przystawik | 239/19 X |

*Primary Examiner*—Andres Kashnikow
*Assistant Examiner*—Patrick N. Burkhart
*Attorney, Agent, or Firm*—Merrill N. Johnson

[57] ABSTRACT

Mechanism for adjustably moving two separate series of water fountain nozzles. The mechanism includes a pair of elongated push rods being driven in opposite directions by a single electric motor having two eccentric arms. The push rods are each separately connected to a spaced series of fountain nozzle assemblies by a slip ring adjustably connected to an elongated length of pipe forming part of each nozzle assembly. By varying the location of the slip ring along the length of the nozzle assembly's pipe, infinite variations in the extent of the arc through which the nozzle's tip will sweep during oscillation of the push bars is achieved.

2 Claims, 1 Drawing Sheet

MOVING MEANS FOR FOUNTAIN NOZZLE

BACKGROUND AND SUMMARY OF THE INVENTION

The invention lies in the field of water fountains and in particular relates to means for oscillating or moving a plurality of fountain nozzles discharging streams of water.

In my prior U.S. Pat. No. 3,907,204 I disclosed and showed means for oscillating a plurality of nozzles which included specific means in the form of a line of adjustment holes 84 in arm extension 64. By varying the distance between pivot points 34 and 66, nozzles 60 would move through different predetermined arcs to achieve different visual effects as part of a spectacular display of constantly moving fountains synchronized with music and multi-colored lighting.

However, I have found that use of the nozzle moving means shown in FIGS. 1 and 2 of my prior U.S. Pat. No. 3,907,204 has a number of disadvantages. The flexible hose 26 which is continuously flexed by yoke 40 eventually leaks or ruptures due to its constant movement. The continuous back-and-forth movement of flexible hose 26 and rigid pipe 56 often creates turbulence in the water supply causing erratic and uneven discharge of water from nozzle 60. Moreover, the arc through which the tip of nozzle 60 sweeps is not infinitely variable, but is limited to a few variations by the number of holes 84 in arm extension 64.

A further disadvantage of the nozzle moving means provided by U.S. Pat. No. 3,907,204 lies in the use of a single crank arm 72 and links 90 and 90' and rocket 94 to 72 move the two push rods 68 and 68' in opposite directions. I have found difficulties in reliable operation of this arrangement.

Accordingly, I have developed improved means for oscillating a plurality of fountain nozzles over predetermined and adjustable arcs to create desired movements of the streams of water from such nozzles.

These improvements include elimination of any flexible hose in feeding water to the nozzles thereby reducing water turbulence and insuring even, uniform flow from the nozzles. In addition, I have developed apparatus which permits infinitely variable adjustment of the arc thru which the nozzles will sweep, and using only a single motor I have developed a system for reliably controlling two series of nozzles moving in opposite directions.

Briefly, my improved fountain nozzle moving means includes the use of a pair of push rods each driven by a single motor having two eccentric arms. The push rods are are each separately connected to s series of slip rings. Each slip ring is slidably connected to an elongated length of pipe which feeds water to one of the fountain nozzles. By varying the location of the slip ring along the length of the pipe, I achieve infinite variation in the number of degrees of the arc through which the fountain nozzles will sweep during oscillation of the push bars. Each of the two push bars oscillates one series of nozzles which are thus caused to move in similar but opposite directions by the operation of a single motor.

DETAILED DESCRIPTION OF A PREFERRED EMBODIMENT

Figure 1:
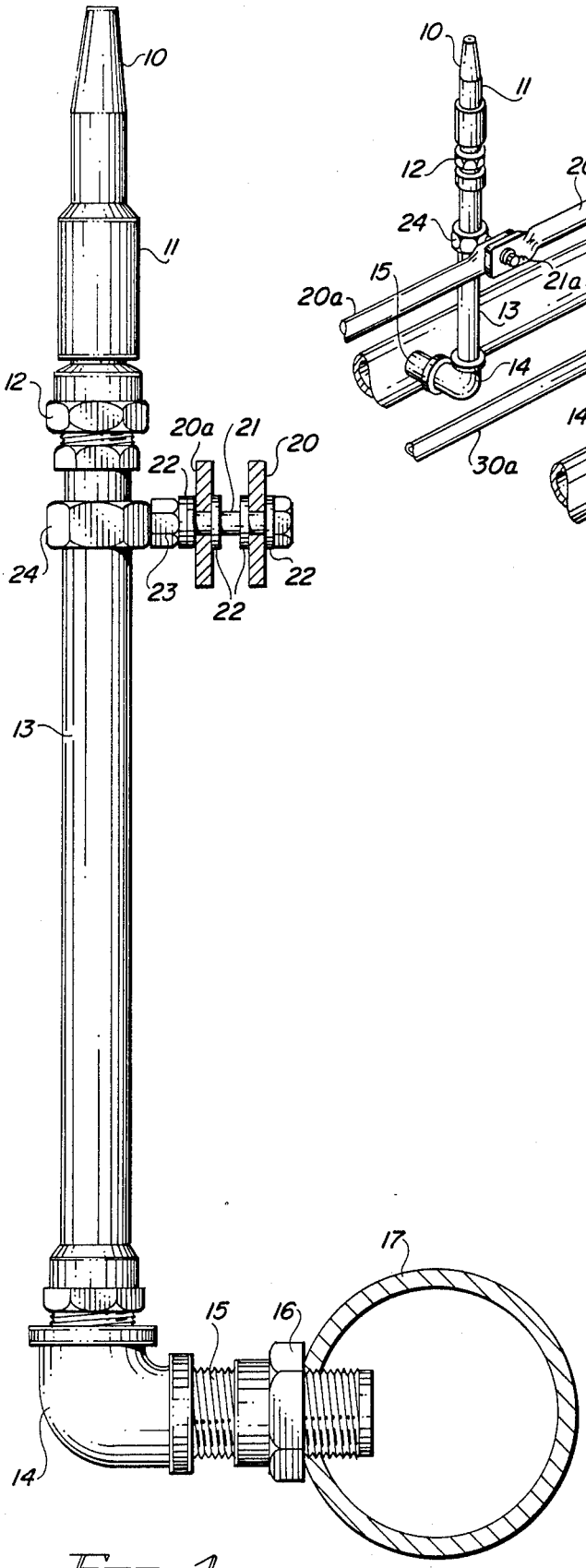
FIG. 1 is a front elevational view of a preferred embodiment of my improved fountain nozzle moving means showing the connection of the nozzle assembly to a water supply conduit and also to a push bar for oscillation of the nozzle.
Figure 2:
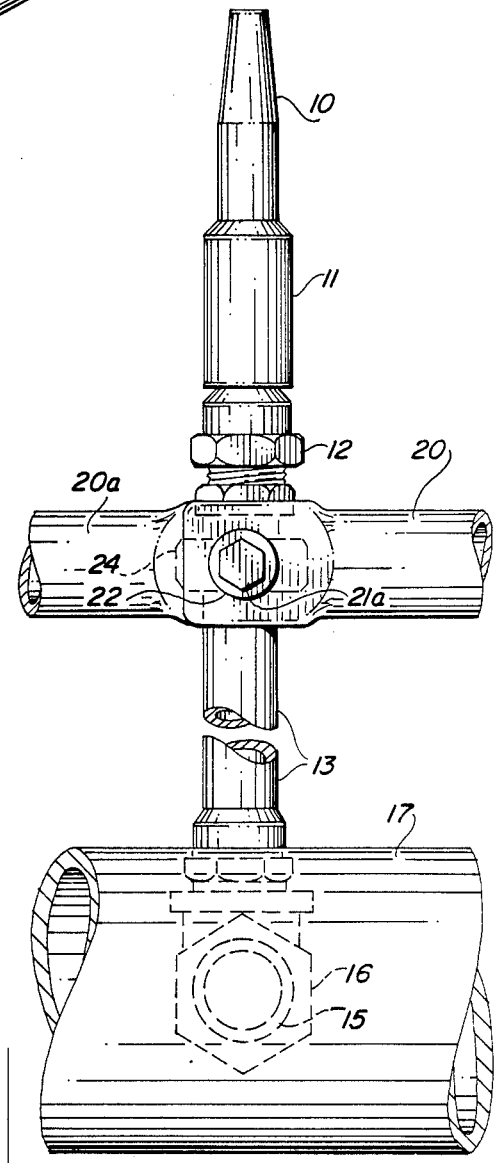
FIG. 2 is a side elevational view partially cut away of the nozzle shown in FIG. 1.

With particular reference to FIGS. 1 and 2 of the drawings, the preferred embodiment of my invention includes fountain nozzle tip 10 preferably made of brass and soldered to a straight section of lead pipe 11. The use of lead pipe permits accurate minute adjustment of the direction of flow of water from nozzle tip 10.

The lower end of lead pipe 11 is connected preferably by soldering to copper or brass internally threaded bushing 12 which in turn is connected to the upper end of elongated copper pipe 13. The lower end of pipe 13 is connected to a 90° elbow which is pivotably connected by a short length of externally threaded pipe 15 and a polyvinyl chloride (PVC) internally threaded fitting 16 to a PVC pipe line 17 which feeds water to the nozzle tip 10.

This nozzle assembly is adjustably connected to stainless steel push bar 20 and to push bar extension 20a by stainless steel bolt 21, stainless steel locking nut 23 and brass washers 22 as best shown in FIG. 1 and brass slip ring 24. The internal diameter of slip ring 24 is just slightly larger than the outside diameter of pipe 13 to permit incrimental adjustment of the position of ring 24 along the extent of pipe 13, and then locking the ring in place by turning the head 21a of bolt 21 until the end of the bolt fits snugly against pipe 13 and is then locked in place by turning locking nut 23.

Figure 3:
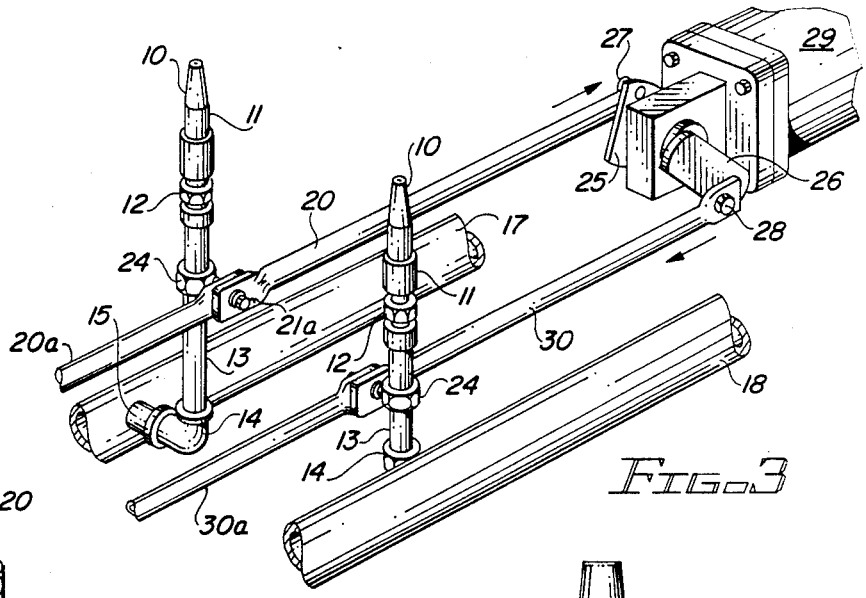
FIG. 3 is a perspective view partially broken away of the two push bars connected to the two opposite eccentric arms of the motor and showing each of the push arms connected to one of a series of fountain nozzles being oscillated by the push rods.

As shown in FIG. 3, a single variable speed electric motor 29 is fitted to oscillate two series of fountain nozzles 10 in opposite directions. Motor 29 is connected to operate an eccentric mechanism which includes eccentric arms 25 and 26. The ends of arms 25 and 26 are respectively connected by pins 27 and 28 to the flattened ends of a pair of push rods 20 and 30 which are moved in opposite directions by motor 29 and eccentric arms 25 and 26.

The flattened opposite ends of push rods 20 and 30 are pivotably connected to bolt 21 of the first nozzle assembly of a series of nozzles as shown in FIG. 3. The remaining nozzle assemblies of each series are connected to push rod extension 20a or to push rod extension 30a shown in FIG. 3.

Thus push rods 20 and 30 and push rod extensions 20a and 30a are each adjustably connected to a separate series of fountain nozzles 10, one nozzle of each series being shown in FIG. 3. By varying the position of slip rings 24 along the length of pipes 13 of each nozzle assembly, the extent of the arc through which nozzle tips 10 will move by oscillation of push rods 20 and 30 and push rod extensions 20a and 30a can easily be varied as desired by the operator of the moving water fountain display.

While I have illustrated and described a preferred embodiment of my improved fountain nozzle moving means, it will be apparent to those skilled in the art of moving fountain displays that various modifications and changes in the mechanism may be made without departing from the spirit of my invention, whose true scope is limited only by the appended claims.

I claim:

1. Mechanism for adjustably moving two separate series of water fountain nozzle assemblies comprising an electric motor connected to drive two separate eccentric arms, first and second eccentric arms, first and second elongated push rods with one end of the first push rod being pivotably connected the first eccentric arm and one end of the second push rod being pivotably connected to the second eccentric arm, two series of spaced apart identical fountain nozzle assemblies, each nozzle assembly including an elongated length of pipe having a uniform outside diameter, each series of nozzle assemblies being pivotably connected to one of the push rods by a series of slip rings each encircling the elongated length of pipe of one of the nozzle assemblies, and a bolt pivotably attached to the push rod and threaded through each slip ring to bear against the pipe in order to affix the slip ring to the pipe.

2. Mechanism for adjustably moving a water fountain nozzle assembly comprising a fountain nozzle assembly which includes an elongated length of pipe having a uniform outside diameter and a nozzle tip on one end of the assembly, said assembly being pivotably mounted to oscillate the nozzle tip about the other end of the assembly, an elongated push rod connected to oscillate back-and-fourth over a fixed path, a slip ring encircling the elongated length of pipe of the nozzle assembly and pivotably connected to the push rod, and means pivotably attached to the push rod and threaded through the slip ring to bear against the pipe in order to affix the slip ring to the pipe.

* * * * *